US006889387B1

(12) United States Patent
Tiss et al.

(10) Patent No.: US 6,889,387 B1
(45) Date of Patent: May 10, 2005

(54) COLLAR PROTECTOR

(75) Inventors: Irving Tiss, Springfield, NJ (US); Burton J. Schwartz, Livingston, NJ (US)

(73) Assignee: DES-L Industries Inc., Irvington, NJ (US)

( * ) Notice: Subject to any disclaimer, the term of this patent is extended or adjusted under 35 U.S.C. 154(b) by 214 days.

(21) Appl. No.: 09/904,427

(22) Filed: Jul. 12, 2001

(51) Int. Cl.[7] ..... A41B 3/06; A41D 27/16
(52) U.S. Cl. ..... 2/60; 2/132; 223/83
(58) Field of Search ..... 2/60, 132, 134, 2/129, 130, 136, 155, 156, 255, 258, 131, 133, 137; 223/83, 84, 71, 66, 68, 81, 82

(56) References Cited

U.S. PATENT DOCUMENTS

| | | | | | |
|---|---|---|---|---|---|
| 44,319 | A | * | 9/1864 | Murphy | 74/62 |
| 1,083,826 | A | * | 1/1914 | Graubarth | 2/132 |
| 1,487,396 | A | * | 3/1924 | Jack | 2/129 |
| 1,777,814 | A | | 10/1930 | Vita | |
| 1,876,814 | A | | 9/1932 | Wilson | |
| 1,879,918 | A | | 9/1932 | Steele | |
| 1,882,355 | A | * | 10/1932 | McCormick | 2/132 |
| 1,899,602 | A | * | 2/1933 | Alexander | 223/83 |
| 1,959,598 | A | * | 5/1934 | Rubel | 2/132 |
| 2,147,519 | A | * | 2/1939 | Washington | 223/83 |
| 2,155,065 | A | * | 4/1939 | Steele | 223/83 |
| 2,192,834 | A | * | 3/1940 | Kuhn | 2/132 |
| 2,275,098 | A | | 3/1942 | Welch | 223/83 |
| 2,304,464 | A | * | 12/1942 | Manaster | 2/132 |
| 2,322,672 | A | * | 6/1943 | Steele | 223/83 |
| 2,413,756 | A | * | 1/1947 | Feeley | 2/132 |
| 2,508,126 | A | * | 5/1950 | Turner | 2/132 |
| 2,518,300 | A | | 8/1950 | Fine, Sr. | 223/83 |
| 2,559,406 | A | * | 7/1951 | Darling | 223/83 |
| 2,560,684 | A | | 7/1951 | Calder | 223/83 |
| 2,562,519 | A | * | 7/1951 | Ashley | 2/132 |
| 2,846,127 | A | * | 8/1958 | Tomarin | 223/83 |
| 3,072,306 | A | * | 1/1963 | Macrides et al. | 223/84 |
| 3,107,830 | A | * | 10/1963 | Teague | 223/83 |
| 3,760,994 | A | * | 9/1973 | Taimisto | 223/83 |
| 3,865,286 | A | * | 2/1975 | Tiss | 223/83 |

OTHER PUBLICATIONS

Patent Drawings—document #620627, dated 1959.
Patent Drawings—document #87,090, dated 1954.
Patent Drawings—document #160,936 dated 1953.

* cited by examiner

*Primary Examiner*—Amy B. Vanatta
(74) *Attorney, Agent, or Firm*—Lerner, David, Littenberg, Krumholtz & Mentlik, LLP

(57) ABSTRACT

A collar protector for preventing the collar on a shirt or other garment from being crushed, distorted or wrinkled during handling when the shirt or garment is stored, stacked or displayed. The collar protector is constructed as a shaped, unitary body made of a resilient, preferably plastic, material.

30 Claims, 6 Drawing Sheets

FIG 13
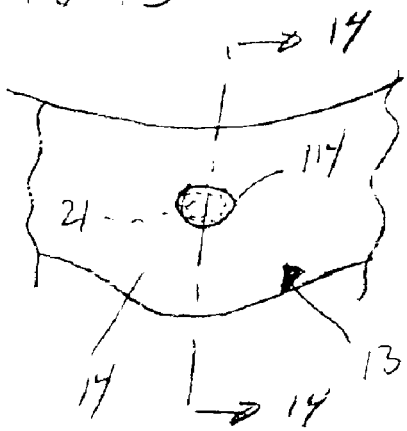
FIG 18
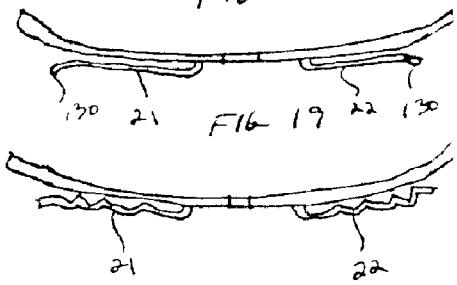
FIG 19
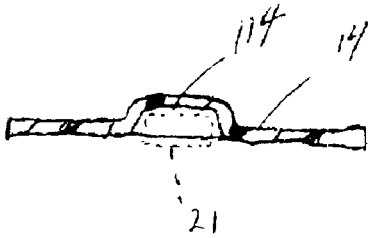
FIG 14
FIG 15
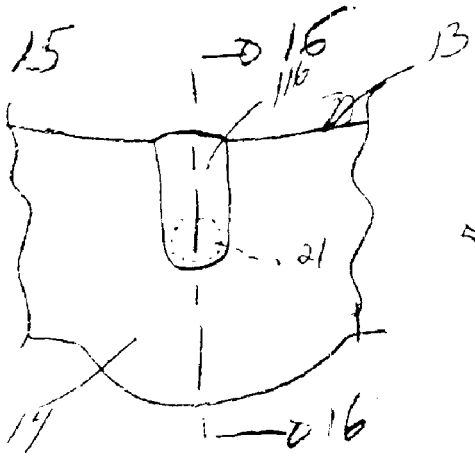
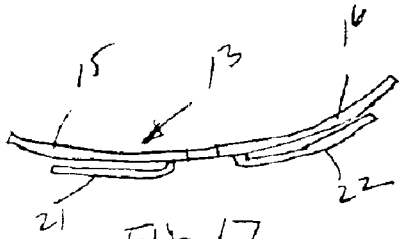
FIG 17
FIG 16
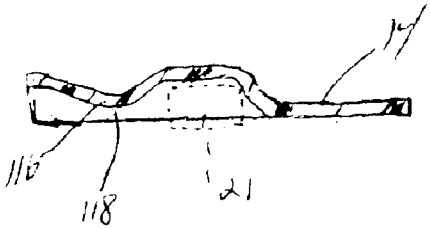

COLLAR PROTECTOR

BACKGROUND OF THE INVENTION

The present invention relates generally to collar supports and protectors, and more particularly, to a generally unitary shaped collar protector fabricated or molded from a resilient material such as a plastic which is easy to install and remove from the collar section of a shirt or other garments and which holds and protects the collar in assembled position and prevents the collar from being distorted or wrinkled during all times that the shirt is stored, stacked and/or displayed.

In the storing, packing or stacking of shirts for display, cleaning, inventory and other purposes relating to all clothing, where such shirts have collar sections, the collar sections often become distorted, creased and misshapen. This affects both the appearance of the shirt for display purposes, its presentation to customers by cleaners who launder such shirts, and more importantly affects the utility of the shirt for its regular and ordinary purposes.

Various efforts have been made to overcome these problems as is shown in U.S. Pat. Nos. 1,777,814; 1,876,814; 1,879,918; 2,275,098; 2,518,300; 2,560,684; Norwegian Patent No. 87090 (1956); Sverige Patent No. 160,936 (1957) and Italian Patent No. 620,627 (1961).

In U.S. Pat. No. 1,876,814 a collar support is shown made of a one-piece, generally V-shaped design of stiff cardboard material for attachment under the collar section of a garment and in engagement with the neck portion of the collar so that spaced relatively small wing portions on opposite sides of the centerline of the collar support can be pushed out to engage and overlie the front ends of the collar to hold them from being distorted and wrinkled.

Norwegian Patent No. 87,090 shows a collar support having an arcuate portion which slides under the collar portion of a garment. In the center of the upper edge of the arcuate portion a V-shaped notch is formed. When the collar support slides under the collar, the V-shaped notch will engage the collar button at the neck portion of the collar. The V-shaped notch coacts with a downwardly extending, generally narrow flat member, which is connected at one end to the center of the lower edge of the arcuate portion. At the free end remote therefrom, the flat member has a V-shaped notch which engages the spaced shirt button below the collar button to hold the collar support in assembled position.

Italian Patent No. 620,627 also shows a collar support with a V-shaped notch in the upper edge for engagement with the collar button in the neck portion of the collar to act as an attachment for the collar support shown.

U.S. Pat. Nos. 2,518,300 and 1,879,918 disclose collar supports having an arcuate portion which slides under the collar portion of a garment. A portion of the collar support is provided with spaced apart cutouts to allow for the formation of tabs which may be positioned over a portion of the collar for protecting same.

U.S. Pat. No. 2,275,098 discloses a collar support having an arcuate portion which slides under the collar portion of a garment. An extending lateral wing is foldable about the arcuate portion to overlie a portion of the collar. The wings have a pair of spaced apart slots through which a portion of the collar may be inserted for securing same.

From the foregoing, there is known a variety of collar protectors constructed for attachment by various means to a collared garment. These designs have a number of disadvantages such as difficulty in assembling of the collar support into its intended configuration, difficulty in manipulating the collar support when attaching to the collar portion of a garment, complexity of removing the collar support and/or time consumption for constructing the collar support and its attachment to a garment. Accordingly, there is the need for improvements in collar supports for use with garments having a collar for the protection of same.

SUMMARY OF THE INVENTION

The present invention overcomes the aforesaid problems attributable to the known collar supports by providing an improved unitary collar protector made of a plastic material which may take the arcuate shape of the neck band portion of the collar, along the longitudinal or lengthwise line of the collar protector. The collar protector as to be described, may also have an arcuate or concave shape, transverse to the longitudinal line of the collar protector. The collar protector has a center section and spaced side sections connected at one end to the center section and extending in opposite directions. An attachment assembly is formed on the center section for operative engagement with the collar button at the neck band portion of the collar to make it easy to install and remove the collar protector. Shaped oppositely extending elongated holding members are provided on the oppositely extending side sections and engage the outer face and hold the front tab sections of the collar when the collar protector is in assembled position on the shirt. The elongated holding members have a convoluted shape which can be used to increase the force exerted by the elongated holding members for holding the tab sections and for holding the collar protector in assembled position while securing the front tab sections of the collar.

One aspect of the present invention is directed to a collar protector for the collar of a garment fabricated as a shaped unitary body of resilient material. The body has a center section and spaced side sections each respectively connected at one end to the center section and extending in opposite directions from the center section. The center section has an attachment assembly to facilitate attachment of the collar protector under the collar of a garment. Each of the side sections have a resilient holding member disposed for operative engagement with the outer face of the collar to secure the front tab sections of the collar.

In another aspect of the present invention, there is disclosed an improved collar protector in which the attachment assembly comprises a V-shaped notch in the upper edge of the center section. The V-shaped notch is wide at the upper edge and extends inwardly a predetermined distance about equal to the distance of the attachment of the collar bottom on the neck portion of the collar being protected. The V-shaped notch tapers to a restricted opening such as a rounded section which is disposed for engagement with the collar button attachment i.e., threads. The V-shaped notch is adapted to facilitate easy assembly of the collar protector on the garment during use thereof.

In another aspect of the present invention, there is disclosed an improved collar protector in which the attachment assembly comprises a recessed or depressed portion in the center section. The depressed portion is sized and shaped to receive the button on the shirt. The button is captured in the depressed portion to secure the collar protector in its assembled position on the shirt.

In another aspect of the present invention, there is disclosed an improved collar protector in which the resilient holding members are convoluted to enable them to exert additional force on the front tab sections of the collar when in assembled position. By way of example, the holding members may have an S-shape.

In a still further aspect of the present invention, there is disclosed a collar protector in which the shaped unitary body is fabricated or molded in three dimensional form so that it has an arcuate shape along the longitudinal or lengthwise direction of the collar protector, and optionally, an arcuate or concave shape traverse to the longitudinal direction.

Accordingly it is an object of the present invention to provide a collar protector of unique construction and relatively inexpensive to manufacture which can be easily assembled and disassembled to the collar of a garment and thus prevent the collar from being distorted or wrinkled.

It is another object of the present invention to provide a collar protector for the collar of a garment which in assembled position will provide oppositely extending resilient holding members for engagement with the outer face of the collar to maintain the collar neat and orderly.

It is another object of the present invention to provide a collar protector for the collar of a garment having a collar button engagement section or attachment assembly for enabling the collar protector to be easily assembled to the collar and to provide oppositely extending resilient holding members for engagement with the outer face or front tab sections of the collar to maintain the collar tab sections in proper position to prevent the collar from becoming distorted or wrinkled.

It is still a further object of the present invention to provide a collar protector which can be fabricated or molded in three dimensional forming of plastic material.

In accordance with one embodiment of the present invention, there is provided a three dimensional collar protector constructed from plastic material comprising a generally unitary body made of polymer material; the body having a center section and spaced side sections each respectively connected at one end to the center section and disposed to extend in opposite directions from the center section, the center section and a first portion of each of the side sections disposed in a first plane; and each of the side sections having a holding member, each of the holding members having a first portion disposed above the first plane, the holding members arranged for operative association with the collar on a garment to hold the collar is positioned.

BRIEF DESCRIPTION OF THE DRAWINGS

Other objects and advantages of the invention including the basic design and the nature of the improvements thereon will appear from the following description taken in conjunction with the accompanying drawings, in which:

FIG. 13 is a rear elevational view of a portion of the center section of the collar protector having an attachment assembly constructed in accordance with another embodiment of the present invention;

FIG. 14 is a transverse cross-section taken on line 14—14 of FIG. 13;

FIG. 15 is a rear elevational view of a portion of the center section of the collar protector having an attachment assembly constructed in accordance with another embodiment of the present invention;

FIG. 16 is a transverse cross-section taken on line 16—16 of FIG. 15;

FIG. 17 is a top plan view of a collar protector having holding members constructed in accordance with another embodiment of the present invention;

FIG. 18 is a top plan view of a collar protector having holding members constructed in accordance with another embodiment of the present invention;

FIG. 19 is a top plan view of a collar protector having holding members constructed in accordance with another embodiment of the present invention;

FIG. 20 is a top plan view of a collar protector constructed in accordance with another embodiment of the present invention;

FIG. 21 is a front elevational view of the collar protector shown in FIG. 20.

DETAILED DESCRIPTION

In describing the preferred embodiments of the subject matter illustrated and to be described with respect to the drawings, specific terminology will be resorted to for the sake of clarity. However, the invention is not intended to be limited to the specific terms so selected, and is to be understood that each specific term includes all technical equivalence which operate in a similar manner to accomplish a similar purpose.

Figure 1:
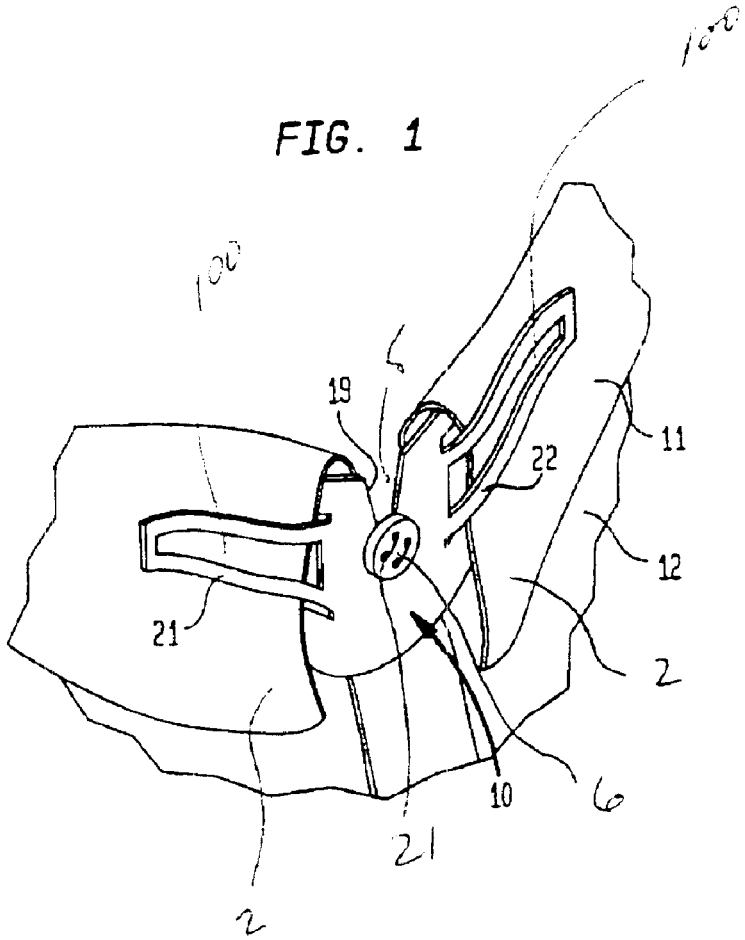
FIG. 1 is a perspective view of one form of the collar protector in accordance with the present invention in assembled position on the collar section of a shirt.

Referring to the drawings, FIG. 1 shows a perspective view of one embodiment of the collar protector in accordance with the present invention generally designated by reference numeral 10 in operative engagement with the collar 11 of a shirt 12 having collar tab sections 2. While the collar protector 10 is illustrated with respect to a shirt, those skilled in the art will recognize that the illustrated embodiment of the invention is also adapted for use with any garment having a collar without departing from the scope of the present invention.

Figure 2:
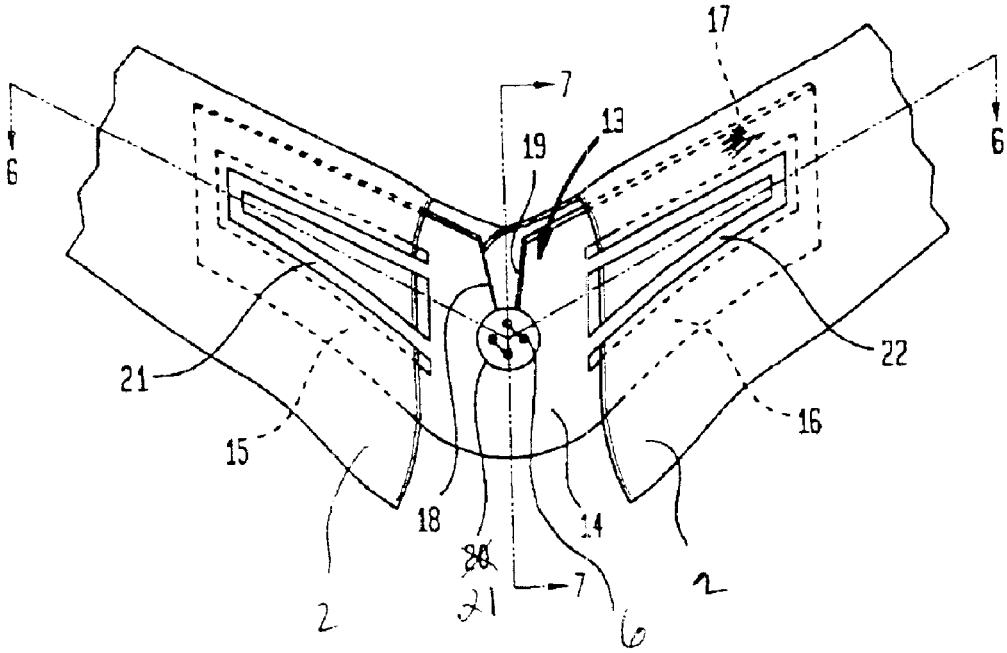
FIG. 2 is a front elevational view of the collar protector shown in FIG. 1.

In FIG. 2, the collar protector 10 in front elevational view is shown to have a generally V-shaped unitary member or body 13 having a center section 14 and spaced side sections 15 and 16 connected at one end hereof to the center section 14 and at their free ends extending in opposite directions from the center section. The angle at which the side sections 15 and 16 define the V-shape of the collar protector 10 more or less follows the neckline of the collar 11 being protected.

Referring to FIGS. 1–7, the unitary body 13 is fabricated or molded, e.g., injection molded, casting, hot stamping and the like from any suitable material, preferably plastic material such as polyethylene, polyester, polypropylene, other resilient polymers and the like. The collar protectors 10 as to be described, have a three dimensional collar shape. The protector 10 when constructed of plastic can be easily stacked together in assembled form without loosing their shape so that the packaging of the collar protectors in accordance with the present invention for shipment to customers is relatively easy after they have been sold into the commercial marketplace. The use of plastic materials is also preferred because when proper materials are selected, the collar protector 10 can be adapted to provide resilient characteristics to elements of the collar protector 10 to aid in maintaining the collar protector in assembled position on the collar of the shirt or other garment, as is more fully described hereinafter.

The body 13 has an upper edge 17 on the center section 14 and side sections 15 and 16. In upper edge 17 at the center section 14, an inwardly extending attachment assembly 18 is formed. The attachment assembly 18 is a generally V-shaped notch 5 which extends in from the upper edge 17 a predetermined distance approximately the same distance as the collar button 21, centered in the neck portion of the collar. The inwardly extending V-shaped notch 5 of the attachment assembly 18 is wide at its upper end 19 and narrows or tapers to a restricted opening such as, by way of one example, a rounded section as at 20. Thus, when the body 13 is pushed into position on the inner or underside of the collar 11, it can be easily secured because of the relatively wide V-shaped notch 5 of the attachment assembly 18 which will receive and capture the attachment threads 6 of the collar button 21 of the shirt or garment. Conversely, because the V-shaped notch 5 of the attachment assembly 18 is relatively wide at the upper edge, the collar protector can also be easily dissembled from engagement with the collar of the shirt or garment.

Figure 3:
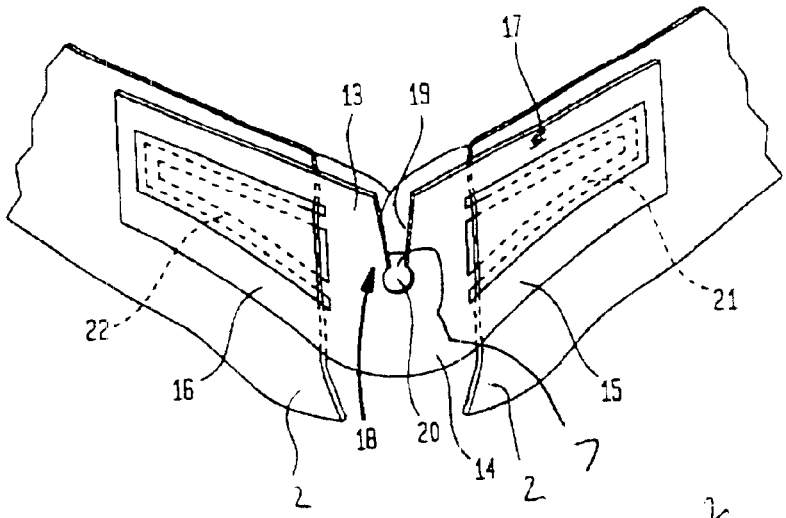
FIG. 3 is a rear elevational view of the collar protector shown in FIGS. 1 and 2 showing the attachment assembly in accordance with one embodiment of the present invention.

In accordance with the preferred embodiment, the V-shaped notch 5, as shown in FIG. 3, is provided with a restricted section 7 which forms a narrow passageway to the rounded section 20. The restricted section 7 is sized so as to allow the attachment threads 6 of the button 21 to be forced there passed into the rounded section 20. In this manner, the restricted section 7 prevents the inadvertent removal of the collar protector 10 when in its secured position.

In order to maintain the tab sections 2 of the collar 11 in a flat condition, thereby preventing them from being creased, distorted or becoming wrinkled and the like, side sections 15 and 16 are provided with resilient holding members 21 and 22. The holding members 21 and 22 are struck from or formed in the lengthwise lines of the respective side sections 15 and 16 during the fabrication or molding of the collar protector 10. The respective resilient holding members 21 and 22 are connected at one end to the center section 14 and extending in opposite directions at their free ends. The holding members 21 and 22 may have an opening 100 to reduce the amount of plastic material being used, or may be solid if desired. The holding members 21 and 22 may have any desired shape as shown in front view, such as rectangular, tapered, arcuate and the like.

Figure 4:
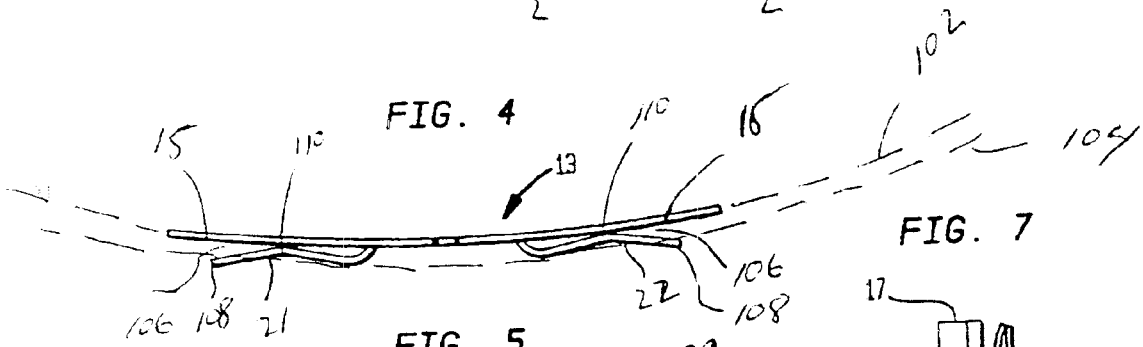
FIG. 4 is a top plan view of the collar protector shown in FIGS. 1 and 2.
Figure 5:
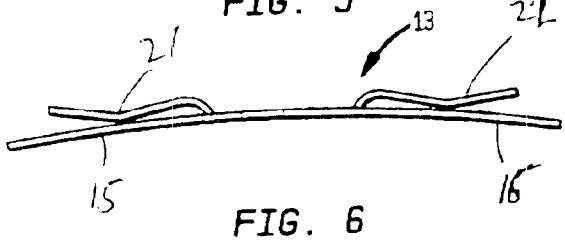
FIG. 5 is a bottom plan view of the collar protector shown in FIGS. 1 and 2.
Figure 6:
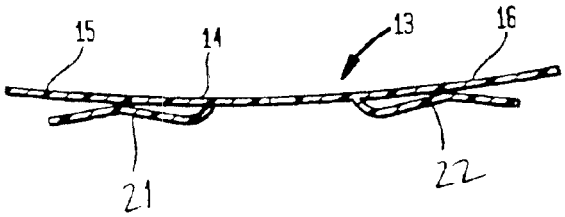
FIG. 6 is a longitudinal cross-section taken on line 6—6 of FIG. 2.
Figure 7:
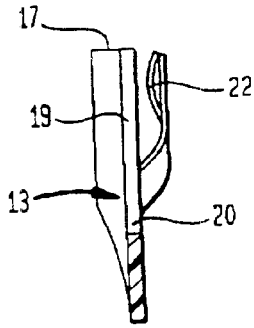
FIG. 7 is a transverse cross-section taken on line 7—7 of FIG. 2.
Figure 8:
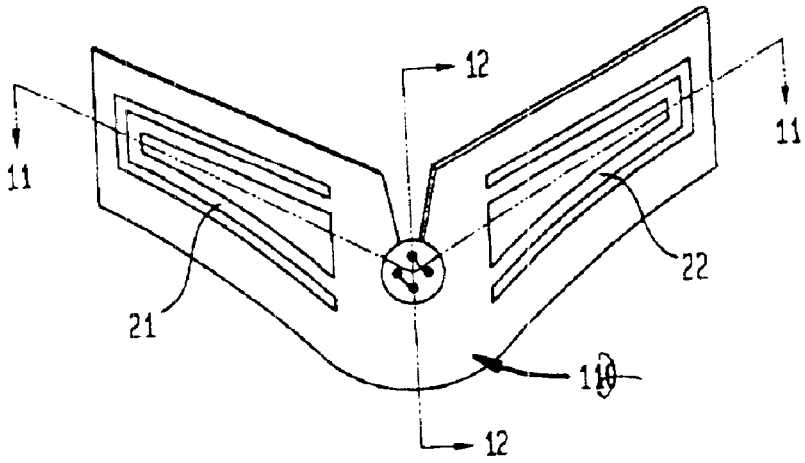
FIG. 8 is a front perspective view of another embodiment of the collar protector in accordance with the present invention in which the collar protector has an arcuate shape in both the lengthwise or longitudinal dimension of the collar protector and transverse to the longitudinal dimensions.
Figure 9:
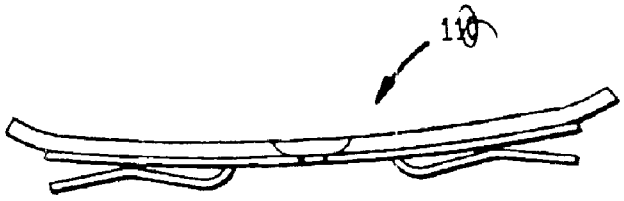
FIG. 9 is a top plain view of the collar protector as shown in FIG. 8.
Figure 10:
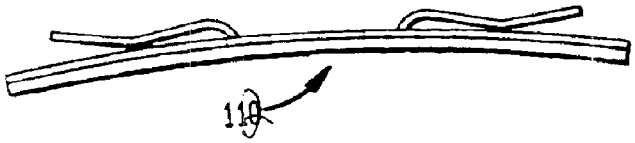
FIG. 10 is a bottom plain view of the collar protector as shown in FIG. 8.
Figure 11:
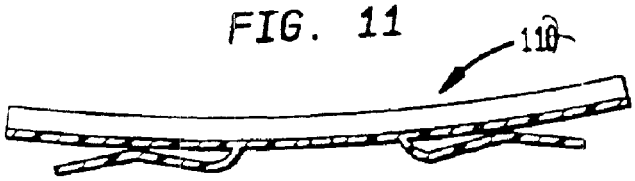
FIG. 11 is a longitudinal cross-section taken on line 11—11 of FIG. 8.
Figure 12:
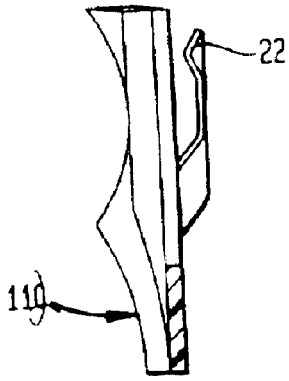
FIG. 12 is a vertical cross-section taken on line 12—12 of FIG. 8 showing the arcuate shape of the collar protector transverse to the longitudinal dimension.
Figure 2A:
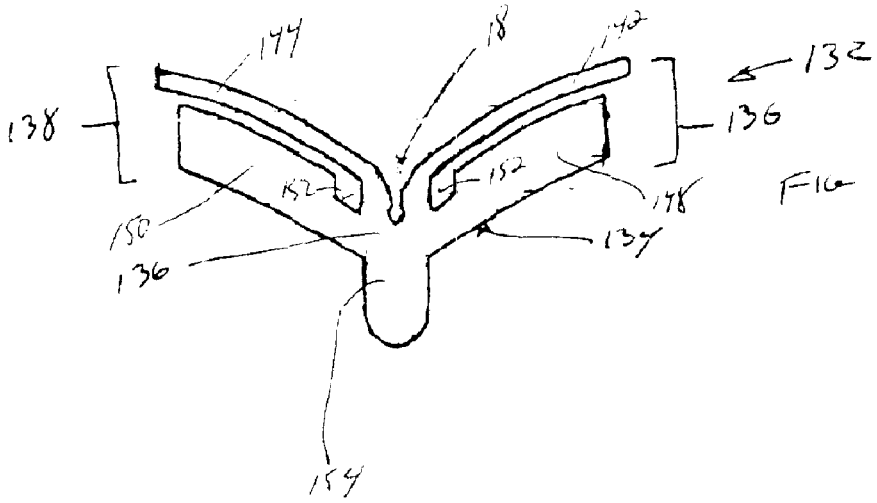
Figure 2D:
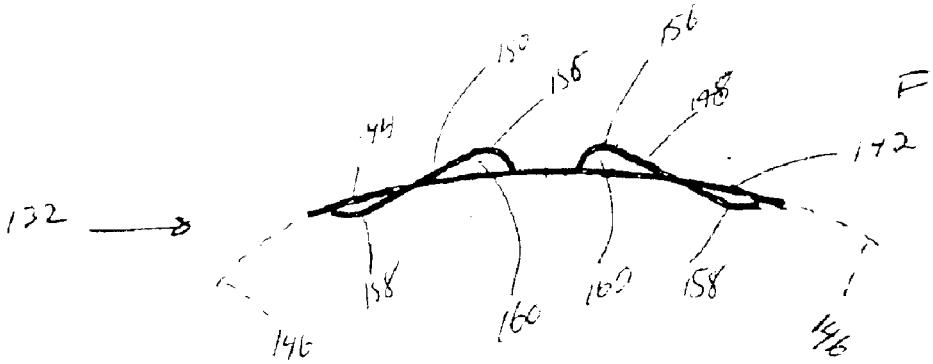

As best shown in FIG. 4, the center section 13 and side sections 15 and 16 lie generally along a first plane 102 which, by way of one example, has a slight radius of curvature. This curvature generally conforms to the curvature of the collar 11. This radius of curvature extends in the longitudinal direction of the collar protector 10. In another embodiment as to be described, the collar protector may also be curved in the transverse direction. The holding members 21 and 22 are formed so as to generally lie in a plane outside plane 102. For example, the holding members 21 and 22 may be formed to generally lie in plane 104 which is generally parallel to plane 102. As a result of this arrangement, i.e., the spaced apart planes 102, 104, there is provided an opening 106 which extends to the leading end of each of the holding members 21 and 22. The opening 106 at the free end of the holding members 21 and 22, as well as therealong, may be greater or less than the space between the respective planes 102 and 104, depending upon the shape of the holding members 21 and 22. For example, as shown in FIG. 4, the holding members 21 and 22 have a generally S-shape such that their leading ends 108 extend away from or out of the plane 104. This increases the size of the opening 106 thereat. Alternatively, the leading end 108 could be displaced downwardly thereby decreasing the opening 106 thereat.

In one embodiment, the leading end 108 will extend away from plane 104. In this manner, the larger opening 106 is operative for guiding the tab sections 2 of the collar 11 into proper position overlying the exterior surface of the body 13 when inserting the collar protector 10. In accordance with one embodiment of the present invention, the S-shape of the holding members 21 and 22 provides a portion 110 which forms a restricted opening through which the tab sections 2 of the collar 11 pass. This restricted section puts a slight compressive force onto the tab sections 2 thereby facilitating maintaining the tab sections in place. It is to be understood that the, holding members 21 and 22 may be of other than S-shape. For example, the holding members 21 and 22 may be as straight members as shown in FIG. 17, may be straight members having upwardly turned ends 130 as shown in FIG. 18, zigzag members as shown in FIG. 19, as well as having portions lying in varying degrees within plane 104 or remote therefrom. From the foregoing description of the collar protector 10, the collar protector is molded to have a three dimensional shape.

When the collar protector 10 is pushed into the assembled position under the given collar being protected, and when the collar protector reaches the stop position, the respective resilient holding members 21 and 22 will be brought into engagement with the outer face of the tab sections 2 of the collar 11. This is facilitated by the openings 106 which will readily receive the edges of the tab sections 2 as the collar protector 10 is being inserted. The insertion of the collar protector 10 can be achieved with a single upward motion without the need to manipulate the holding members 21 and 22 which readily assume their position overlying the tab sections 2. This one step installation is a significant time and labor saving advantage over the known collar protectors. Since the respective holding members 21 and 22 are resilient, they will maintain the tab sections 2 in their intended position to prevent them from being bent, creased, becoming wrinkled and the like. In this regard, the resilient holding members 21 and 22 can have a convoluted shape to create a spring-like structure and thus increase the forces exerted by the resilient holding members in assembled position against the outer surface of the given collar being protected. The holding members 21 and 22 may further coact with the attachment assembly 18 to facilitate holding the collar protector 10 in assembled position, all of which is shown by FIGS. 1–7 of the drawings.

FIGS. 8–12 show a collar protector 112 in accordance with another embodiment that is shaped and formed so that it has an arcuate shape along both the longitudinal or lengthwise direction and the direction traverse to the longitudinal or lengthwise direction. This results in the collar protector 112 having a compound arcuate shape. All of the remaining elements of collar protector 112 are otherwise identical with those as above described, and operate to produce the same advantageous results for holding the collar protector in accordance with the present invention in assembled position. Accordingly, the embodiment as shown in FIGS. 8–12 will not be further described.

Referring to FIGS. 13 and 14, another embodiment of an attachment assembly will now be described. The body 13 in the center section 14 is devoid of the V-shaped notch 5 having a rounded section 20. In its place, a depression or recessed portion 114 is formed at the prior location of the rounded section. The depression 114 is sized and shaped so as to receive the button 21 therein. As the collar protector is slid into position, the shirt button 21 will slide underneath the center section 14 until it is captured by the depression 114. This will prevent the collar protector from being inadvertently removed.

In accordance with another embodiment as shown in FIGS. 15 and 16, the center section 14 may be provided with an elongated depression 116 extending from the depression 114 to the outer edge of the collar protector. The depression 116 will initially guide the button 21 into its proper secured position within depression 114. The depressions 114, 116 may be separated by an area of 118 of reduced cross-section which will prevent the collar protector from being inadvertently removed. In the embodiments describes with respect to FIGS. 13–16, the collar protector can be removed by a slight downward force which will allow the button 21 to be released from its depression 114. These embodiments have the advantage of not having to capture the threads 6 which secure the button 21 to the garment.

Referring now to FIGS. 20 and 21, there will be described a collar protector 132 constructed in accordance with the preferred embodiment of the present invention. The collar protector 132, like the collar protectors previously described, includes a unitary body 134 fabricated or molded from suitable material, and preferably plastic material as thus far described. The body 138 is provided with a center section 136 and spaced apart side sections 138, 140 connected at one end thereof to the center section, their free ends extending in opposite directions from the center section. The collar protector 132 may be provided with an attachment assembly 18 as previously described. Accordingly, the attachment assembly 18 can be constructed in various forms, for example, a V-shaped notch 5 or depressions 114, 116 as shown in FIGS. 3, 13 and 15 with respect to the disclosed collar protector embodiments.

The side sections 138, 140 are formed to include a first elongated member 142, 144 having one end attached to the center section 136 and extending away therefrom to a free end. As generally shown in FIG. 20, the center section 136 and elongated members 142, 144 are arranged in a curved plane 146, i.e., having a radius in the longitudinal or lengthwise direction of the body 134. However, it is to be understood that the center section 136 and the elongated members 142, 144 may be arranged in a flat plane, as well as being curved in the transverse direction.

The side sections 138, 140 also form a pair of spaced apart resilient holding members 148, 150 which extend outwardly from the center section 136 to their free ends. In accordance with one embodiment, the width of the holding members 148, 150 are wider than the width of the elongated members 142, 144. The holding members 148, 150 are provided with a cutout 152 along the top edge adjacent the center section 136. The cutout 152 may be of any desired shape, such as rectangular, square, U-shaped, V-shaped and the like for the purpose to be described. As shown in FIG. 21, the length of the holding members 148, 150 is less than the length of the elongated members 142, 144, generally due to their convoluted shape. The center section 136 may be provided with an elongated flat tab 154 extending outwardly therefrom.

As best shown in FIG. 20, the center section 136 and elongated members 142, 144 lie within the plane 146. The holding members 148, 150 are convoluted in shape, for example, having an S-shaped profile. In this regard, a first portion 156 of the holding members 148, 150 lie above the plane 146, while a second portion 158 of the holding members lie below the plane 146. By arranging the second portion 158 below the plane 146, a greater holding force is obtained by the holding members 148, 150 due to their resilient nature. An increase in the holding force can be also achieved by forming the holding members 148, 150 of thicker polymer material or using stiffer polymers.

Figure 22:
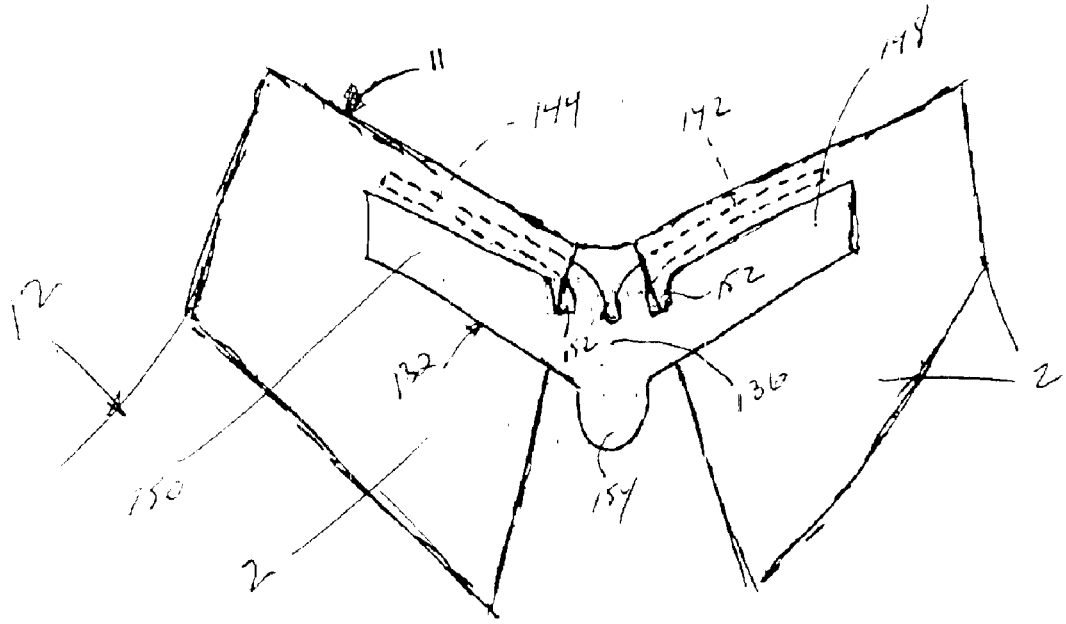
FIG. 22 is a front perspective view showing the collar protector shown in FIG. 21 in attachment to a collared shirt.

The collar protector 132 is inserted into a collared garment in the manner as thus far described and as shown in FIG. 22. In this regard, the elongated members 142, 144 will be arranged under the collar tab sections 2, while the holding members 148, 150 will be arranged overlying the collar tab sections. The upper edge of the collar tab sections 2 are received within the cutouts 152. This minimizes the amount of contact and pressure of the collar protector 132 on the edge of the collar tab sections 2. As such, this in combination with the bowed shape of the first section which provides a vertical space 160, see FIG. 20, avoids any potential for wrinkling of the edge of the collar tab sections 2. The installation and removal of the collar protector 132 may be facilitated by the user grabbing the projecting tab 154 and pulling away from the collar.

There has thus far been described a collar protector for protecting the collar on a garment having a collar button comprising a body made of a resilient material; the body having a center section and spaced side sections each respectively connected at one end to the center section and disposed to extend in opposite directions from the center section; the center section having an attachment assembly formed therein for releasable attachment to the collar button; and each of the side sections having a resilient holding member disposed for operative association with the collar on a garment to hold the collar in position.

There has further been described a collar protector for protecting the collar on a garment having a collar button comprising: a generally unitary body made of polymer material; the unitary body having a center section and spaced side sections each respectively connected at one end to the center section and disposed to extend in opposite directions from the center section; the center section having an attachment assembly formed therein for releasable attachment to the collar button; the attachment assembly comprising an inwardly extending cutaway section, the cutaway section having a predetermined length; and each of the side sections having a resilient holding member disposed for operative association with the collar on a garment to hold the collar in position.

There has further been described a garment having a collar provided with a collar button in combination with a collar protector, the combination comprising: a body made of a resilient material; the body having a center section and spaced side sections each respectively connected at one end to the center section and disposed to extend in opposite directions from the center section; the center section having an attachment assembly formed therein for releasable attachment to the collar button; each of the side sections having a resilient holding member disposed for operative association with the collar on a garment to hold the collar in position; and a garment having a collar to which the collar protector is attached.

There has further been described a three dimensional collar protector constructed from plastic material comprising: a generally unitary body made of polymer material having an arcuate shape in lengthwise direction thereof, the body disposed in a first curved plane; the bodying having a center section and spaced side sections each respectively connected at one end to the center section and disposed to extend in opposite directions from the center section; and each of the side sections having a holding member disposed in a second curved plane spaced from the first curved plane, the holding members arranged for operative association with the collar on a garment to hold the collar is positioned.

Thus an improved collar protector has been shown and described which will serve to keep the collar of a shirt or garment orderly and neat and protect it from distortion and wrinkling during the handling of the shirt or garment on which it is attached. It will be understood that the invention is not to be limited to the specific construction or arrangement of parts shown but that they may be widely modified within the invention defined by the following claims. For example, it is not an essential feature of the present invention that the collar protector be provided with an attachment assembly 18 such as v-shaped notch 5, recessed portion 114 or the like. In this regard, the collar protector will stay in place by virtue of its construction to include side sections 15, 16 and holding members 21, 22 which are engaged with the collar of the garment.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A collar protector for the collar on a garment wherein said collar has, an inner face, an outer face and a collar button, comprising, a body made of a resilient material, said body having a relatively wide center section, said center section having an attachment assembly which is releasably affixed to the collar button, relatively wide and spaced side sections having an inner end and an outer end each respectively connected at the inner end to the center section and disposed to extend in opposite directions from the center section so that each respective outer end forms a free end, each of the respective side sections having a resilient holding member in the medial section of the associated one of the side sections, each resilient holding member is an elongated strip having a strip inner end and a strip outer end and connected at its strip inner end with and extending in the same direction from the connected inner end of its associated one of said side sections, and the strip outer end of each said holding member forming a free end remote from its said connected strip inner end to enable the respective side sections to extend in opposite directions so the outer end of the respective side sections is in engagement with the inner face of the collar and to enable each respective holding member in assembled position to extend to opposite sides of the center section to engage the outer face of the collar on the said garment and to hold and protect the collar.

2. The collar protector in claim 1, wherein the attachment assembly includes an inwardly extending cutaway section with a wide outer end and a restricted inner end.

3. The collar protector in claim 1, wherein said body is constructed of polymer material.

4. The collar protector in claim 1, wherein each elongated strip of each resilient holding member has a convoluted shape.

5. The collar protector in claim 4, wherein the convoluted shape is S-shaped.

6. The collar protector in claim 1, wherein said body has an arcuate shape in the lengthwise direction of the collar protector.

7. The collar protector in claim 1, wherein said body has an arcuate shape in the lengthwise direction of the collar protector and an arcuate shape transverse to the lengthwise direction of the collar protector.

8. The collar protector in claim 1, wherein the body is constructed of plastic material having a three dimensional shape.

9. The collar protector in claim 1, wherein the attachment assembly comprises, a depression in the center section.

10. The collar protector in claim 1, wherein the side sections lie in a first plane and the holding members have portions lying in planes extending above and below said first plane.

11. The collar protector in claim 10, wherein said body is constructed of plastic material, said body having an arcuate shape and said holding members having an S-shape.

12. The collar protector in claim 1, wherein the side sections lie in a first plane and the holding members lie in a second plane spaced from the first plane.

13. The combination with a garment having, a collar with an inner face, an outer face and provided with a collar button of a collar protector comprising, a body made of a resilient material, said body having a relatively wide center section, said center section having an attachment assembly which is affixed to the collar button, relatively wide and spaced side sections having an inner end and an outer end, and each of the respective side sections connected at the inner end to the center section and disposed to extend in opposite directions from the center section so that each respective outer end forms a free end, each of the side sections having a resilient holding member in the medial section of the associated one of the side sections, each holding member is an elongated strip having a strip inner end and a strip outer end and connected at its strip inner end with and extending in the same direction from said connected inner end of its associated one of the said side sections, and the strip outer end of each said holding member forming a free end remote from the said connected strip inner end to enable the respective side sections to extend in opposite directions so the outer end of the respective side sections is in engagement with the inner face of the collar and to enable each respective holding member in assembled position to extend to opposite sides of the center section to engage the outer face of the collar on the said garment and to hold and protect the collar.

14. The combination in claim 12, wherein the attachment assembly includes an inwardly extending cutaway section with a wide outer end and a restricted inner end.

15. The combination in claim 12, wherein said body is constructed of polymer material.

16. The combination in claim 12, wherein the elongated strip of each resilient holding member has a convoluted shape.

17. The combination in claim 15, wherein the convoluted shape is S-shaped.

18. The combination in claim 12, wherein the side sections lie in a first plane and the holding members lie in a second plane spaced from the first plane.

19. The combination as in claim 12, wherein said body has an arcuate shape in the lengthwise direction of the collar protector.

20. The combination in claim 12, wherein said body has an arcuate shape in the lengthwise direction of the collar protector and an arcuate shape transverse to the lengthwise direction of the collar protector.

21. The combination in claim 12, wherein the body is constructed of plastic material having a three dimensional shape.

22. The combination in claim 12, wherein the attachment assembly comprises a depression in the center section.

23. The combination in claim 12, wherein the side sections lie in a first plane and each respective holding member has portions lying in planes extending above and below said first plane.

24. The combination in claim 22, wherein said body is constructed of plastic material, said body having an arcuate shape and said holding members having an S-shape.

25. A three dimensional collar protector for the collar on a garment having a collar button and wherein the said collar has an inner face and an outer face, comprising, a generally unitary body made of polymer material; said body having, a relatively wide center section, said center section having an attachment assembly which is affixed to the collar button, relatively wide and spaced side sections having an inner end and an outer end and each of said respective side sections connected at the inner end to the center section and disposed to extend in opposite directions from the center section so that the respective outer end forms a free end, said center section and a first portion of each of said side sections disposed in a first plane; each of the side sections having a holding member in the medial section of the associated one of the side sections, each of the holding members is an elongated strip having a strip inner end and a strip outer end, and connected at its strip inner end with and extending in the same direction from said connected inner end of its associated one of the said side sections, each of said holding members having a first portion disposed above said first plane, and said side sections and their respective holding members arranged to enable the respective side sections to extend their respective outer end for operative association with the inner face of the collar, and each holding member to extend for engagement with the outer face of the collar on said garment to hold and protect the collar in position.

26. The collar protector in claim 24, wherein said first plane is curved in the longitudinal direction of said body.

27. The collar protector in claim 24, wherein each of said holding members have a second portion disposed below said first plane.

28. The collar protector in claim 26, wherein said holding members have an S-shape.

29. The collar protector in claim 24, further including a tab extending away from said center section.

30. The collar protector in claim 24, wherein said first plane is arcuate.

* * * * *

UNITED STATES PATENT AND TRADEMARK OFFICE

CERTIFICATE OF CORRECTION

PATENT NO. : 6,889,387 B1
APPLICATION NO. : 09/904427
DATED : May 10, 2005
INVENTOR(S) : Irving Tiss and Burton J. Schwartz It is certified that error appears in the above-identified patent and that said Letters Patent is hereby corrected as shown below:

On the cover page, at (74), "Krumholtz" should read --Krumholz--.
Column 6, line 37, delete "," after the word --the--.
Column 10, line 63, "12" should read --13--.
Column 10, line 66, "12" should read --13--.
Column 11, line 1, "12" should read --13--.
Column 11, line 4, "15" should read --16--.
Column 11, line 6, "12" should read --13--.
Column 11, line 9, "12" should read --13--.
Column 11, line 12, "12" should read --13--.
Column 11, line 16, "12" should read --13--.
Column 11, line 19, "12" should read --13--.
Column 11, line 21, "12" should read --13--.
Column 11, line 25, "22" should read --23--.
Column 11, line 30, delete "," after word --face--.
Column 11, line 30, delete "," after word --comprising--.
Column 11, line 31, delete "," after word --having--.
Column 12, line 21, "24" should read --25--.
Column 12, line 23, "24" should read --25--.
Column 12, line 26, "26" should read --27--.
Column 12, line 28, "24" should read --25--.
Column 12, line 30, "24" should read --25--.

Signed and Sealed this

Twenty-fourth Day of April, 2007

JON W. DUDAS
*Director of the United States Patent and Trademark Office*